US008531106B2

(12) United States Patent
Demmert et al.

(10) Patent No.: US 8,531,106 B2
(45) Date of Patent: Sep. 10, 2013

(54) HIGH-PRESSURE DISCHARGE LAMP WITH STARTING AID AND METHOD FOR PRODUCING THE SAME

(75) Inventors: Markus Demmert, Berlin (DE); Andreas Hohlfeld, Berlin (DE); Helmut Weske, Berlin (DE); Ingmar Wieler, Berlin (DE); Ludger Wilken, Berlin (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/315,389

(22) Filed: Dec. 9, 2011

(65) Prior Publication Data

US 2012/0146496 A1 Jun. 14, 2012

(30) Foreign Application Priority Data

Dec. 13, 2010 (DE) ..... 10 2010 062 903

(51) Int. Cl.
*H01J 61/54* (2006.01)
*H01J 9/00* (2006.01)

(52) U.S. Cl.
USPC ..... 313/594; 313/607; 313/234; 455/6

(58) Field of Classification Search
None
See application file for complete search history.

(56) References Cited

U.S. PATENT DOCUMENTS 4,223,247 A * 9/1980 Jacobs et al. ..... 315/57
2004/0140769 A1* 7/2004 Horiuchi et al. ..... 313/623
2011/0084587 A1* 4/2011 Uehara et al. ..... 313/113

FOREIGN PATENT DOCUMENTS

WO 2010004472 A2 1/2010

* cited by examiner

*Primary Examiner* — Ashok Patel

(57) ABSTRACT

In a high-pressure discharge lamp including a ceramic discharge vessel, a secure connection between a hybrid antenna as starting aid and a leadthrough of the discharge vessel is provided by virtue of the fact that a means between leadthrough and extension limits the ohmic resistance between leadthrough and hybrid antenna preferably to at most 100Ω.

18 Claims, 11 Drawing Sheets

HIGH-PRESSURE DISCHARGE LAMP WITH STARTING AID AND METHOD FOR PRODUCING THE SAME

CROSS-REFERENCE TO RELATED APPLICATIONS

The present application claims priority from German application No. 102010062903.0 filed on Dec. 13, 2010, the entire contents of which are incorporated herein by reference.

TECHNICAL FIELD

Various embodiments relate to a high-pressure discharge lamp, and to methods for producing a lamp of this type.

BACKGROUND

For sodium vapor high-pressure lamps it is known that, by means of a cermet starting line which is situated on the surface of the PCA ceramic and which is connected to an electrode, and is also designated as a hybrid antenna, the starting voltage can be decreased by comparison with the known systems and, given the same starting voltage, the luminous efficiency can be increased by increasing the xenon pressure; in this respect, see WO 2010/004472.

In WO 2010/004472, a distinction is made between an active and a passive hybrid antenna. The passive hybrid antenna is substantially based on a capacitive coupling of an electrode to the hybrid antenna. In order to achieve an optimum effect, the impedance between hybrid antenna and electrode is intended to be less than 10 kΩ. If a starting unit having an operating frequency of 300 kHz is used, then a coupling capacitance of approximately 55 pF is required in order to realize this condition. Said coupling capacitance can be achieved if, in the case of the sodium vapor high-pressure lamp having a leadthrough diameter of 3 mm and a distance between leadthrough and hybrid antenna of 50 μm, the hybrid antenna is embodied in the form of a cylinder having a height of more than 4 mm, which cannot be realized in practice.

For practical reasons, therefore, an active antenna is advantageous in which the hybrid antenna is connected to the electrode directly or via a connection having a certain ohmic resistance. WO 2010/004472 proposes realizing an electrically conductive connection or a connection having a certain contact resistance, which should not exceed 10 kΩ, but is preferably approximately 10 to 200Ω. For this purpose, it is possible to deposit an electrically conductive layer onto the glass solder by known methods, with the result that the hybrid antenna is electrically connected to the leadthrough of an electrode. What is disadvantageous is that the metals that can be deposited with a sufficiently high melting point and a coefficient of thermal expansion similar to that of the glass solder are not compatible with the existing manufacturing techniques for high-pressure discharge lamps and the integration of new production installations into the existing production processes is therefore required.

WO 2010/004472 also proposes using a conductive glass solder. The latter could be produced by adding a metal, e.g. tungsten, molybdenum, niobium, to the known glass solder powder. This new glass solder has to have a coefficient of thermal expansion similar to that of the known insulating glass solder, it has to produce a good connection to the PCA ceramic and the leadthrough, e.g. composed of niobium, and it has to have sufficient high resistance to diffusion of sodium at the high operating temperatures present of approximately 730° C. What is disadvantageous is that the development and the testing of such a conductive glass solder are very complex.

SUMMARY

In accordance with some embodiments, a high-pressure discharge lamp with starting aid includes a discharge vessel composed of ceramic, two electrodes to which leadthroughs toward the outside are attached, and a starting aid embodied as a hybrid antenna having at least two rings around the discharge vessel and a connection line connecting them. The leadthroughs are fuse-sealed into the end of the discharge vessel by means of glass solder. On one side an extension part of the starting aid is formed as far as a leadthrough. A means between leadthrough and extension part limits the ohmic resistance between leadthrough and extension part to at most 10 kΩ, and preferably to at most 100Ω.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
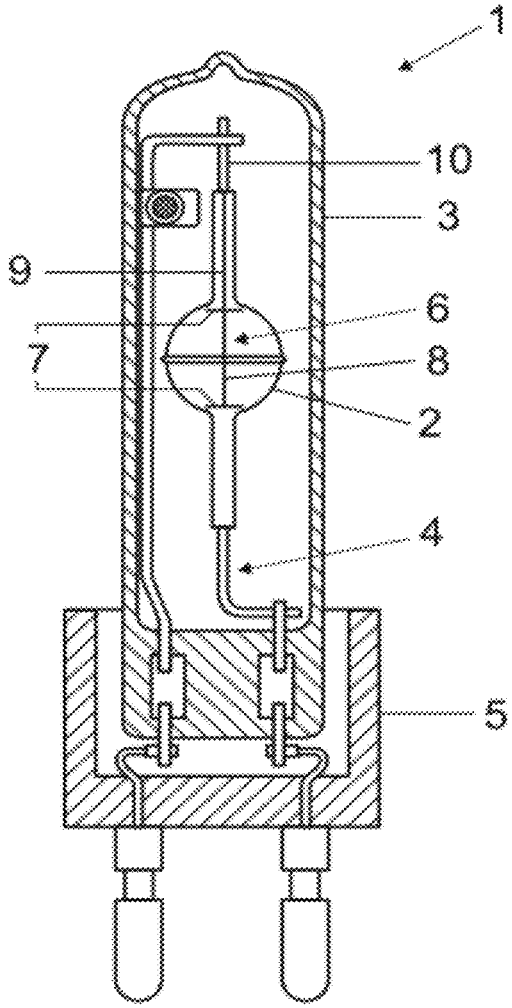
FIG. 1 shows an exemplary embodiment of a metal halide lamp in side view.

In the following description, numerous specific details are given to provide a thorough understanding of embodiments. The embodiments can be practiced without one or several specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Various embodiments provide a high-pressure discharge lamp including a starting device in which the starting device is connected to the electrical leadthrough reliably and with low impedance.

Further embodiments provide a high-pressure discharge lamp in which the starting voltage of the lamp is reduced and/or the luminous efficiency is increased.

Various embodiments relate, in particular, to a metal halide high-pressure lamp or sodium vapor high-pressure lamp including a discharge vessel composed of a polycrystalline aluminum oxide ceramic (PCA). The discharge vessel contains, for example, a metal halide filling, amalgam filling, sodium filling, a starting gas composed of xenon, argon. Two electrodes are fuse-sealed into the PCA ceramic. Moreover, a starting aid composed of a cermet in the form of a line with two rings or areas at the end of the starting line and an extension of the starting line toward an electrode is attached on the outside on the discharge vessel. Finally, a direct electrical connection of said starting line to the electrode is provided. The aim is to specify a technical method for a reliable electrical connection between the hybrid antenna and the leadthrough, such that the starting voltage of the lamp can be reduced or it is possible to increase other characteristic variables such as, for example, the luminous efficiency by increasing the xenon pressure.

Various embodiments provide a technical method by which the hybrid antenna can be connected to the electrical leadthrough reliably, under the precondition that the existing production processes and production installations have to be modified as little as possible. The aim is to reduce the starting voltage in high-pressure discharge lamps or, by means of further-reaching measures, to improve other characteristic lamp properties, e.g. the luminous efficiency in sodium vapor high-pressure lamps by increasing the xenon pressure.

The discharge vessel is produced from ceramic. It can be closed on one side or on two sides.

Various embodiments provide a technology and a production method by which it is possible to realize a direct connection between the hybrid antenna and a leadthrough.

FIG. 1 shows a typical metal halide lamp 1. It has a bulbous ceramic discharge vessel 2, which is mounted in an outer bulb 3 composed of quartz glass by means of a frame 4. The outer bulb 3 is seated in a base 5. The discharge vessel has a hybrid antenna 6 for improving starting, having two ceramic sintering rings 7 around the ends of the discharge vessel and a connection line 8 between the sintering rings 7 and an extension line 9 led from a sintering ring 7 to a leadthrough 10.

Figure 2:
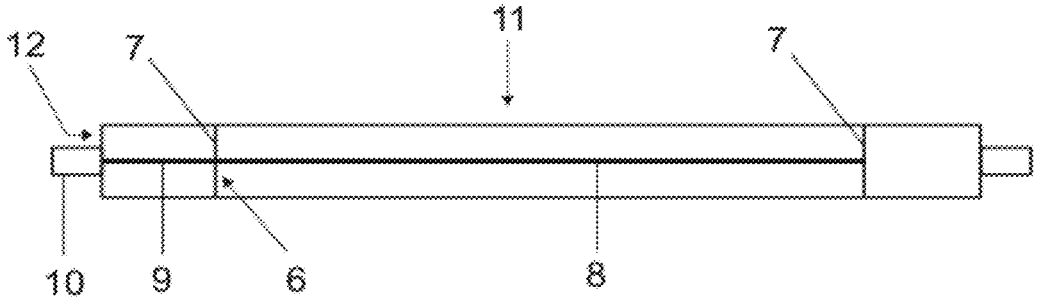
FIG. 2 shows the plan view of the discharge vessel of a sodium vapor high-pressure lamp with a hybrid antenna, with two rings and a connection to the electrode, which lies on the left-hand side.
Figure 3:
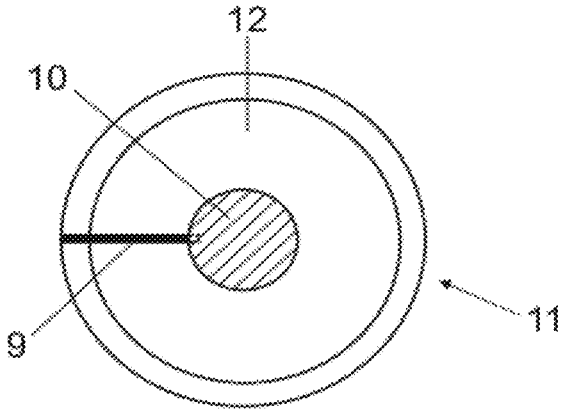
FIG. 3 shows the plan view of the stopper of a PCA ceramic, on which the hybrid antenna runs from the outside inward as far as the hole.

FIG. 2 shows a lateral view of the cylindrical discharge vessel 11 of a sodium vapor high-pressure lamp, e.g. having a power of 400 W. It is produced from PCA ceramic and has a hybrid antenna 6, such that two sintering rings 7 are connected to a connection line 8, which is then extended to the left-hand side of the discharge vessel as far as the end of the discharge vessel with an extension line 9, then is led over the end wall 12 and is led further on the end wall 12 of the discharge vessel 10, which has PCA ceramic as far as the hole and the leadthrough 10, in this respect see the detail in FIG. 3.

Figure 4:
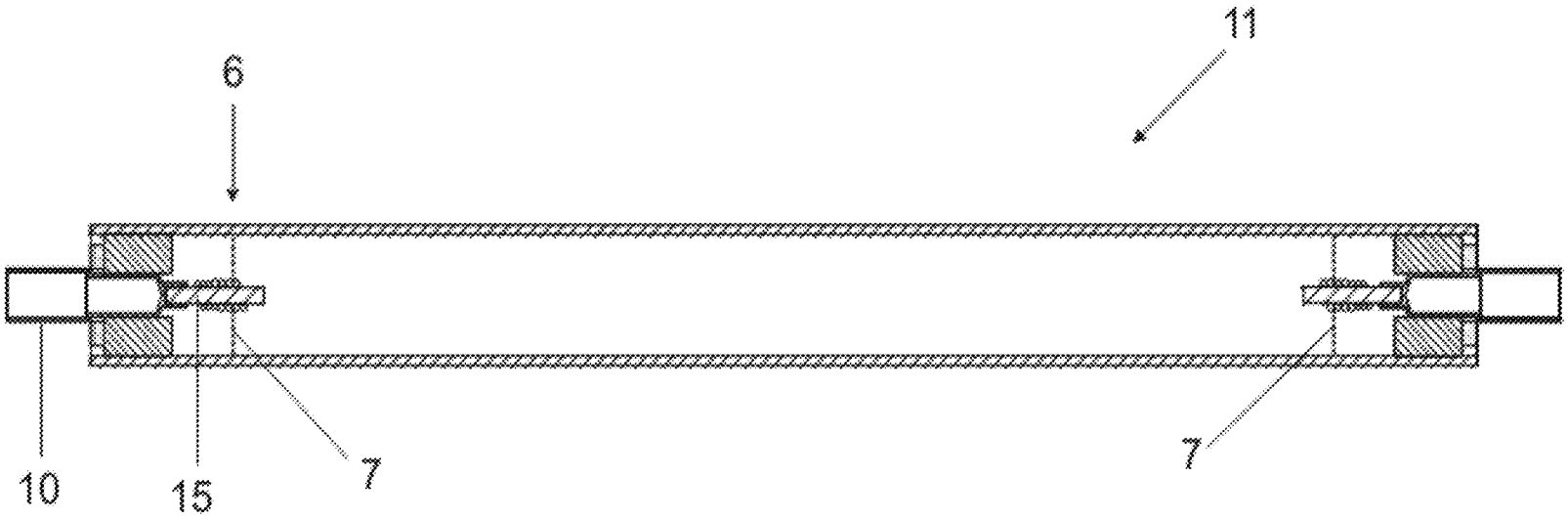
FIG. 4 shows the cross section and view through the discharge vessel of a sodium vapor high-pressure lamp in which the electrodes, the leadthroughs and in the background the rings of the hybrid antenna at the level of the electrodes are visible.

FIG. 4 shows a cross section through the discharge vessel 11 with the hybrid antenna 6. It is indicated herein that the rings 7 lie around the cylindrical discharge vessel 11 at the level of the two electrodes 15.

Figure 5:
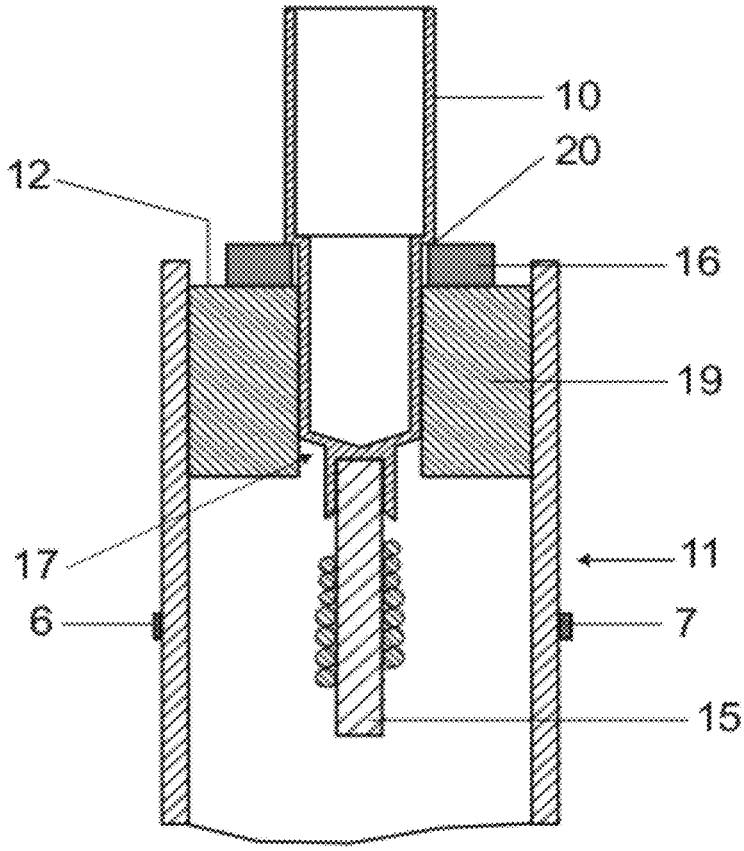
FIG. 5 shows the cross section through the upper region of a discharge vessel before the fuse-sealing, in which the course of the hybrid antenna over the surface of the PCA tube and of the PCA stopper can be seen, in which the glass solder bears on the stopper and the leadthrough is inserted into the hole in the stopper.

FIG. 5 shows a cross section of the ceramic discharge vessel with the hybrid antenna 6 sintered on, before the fuse-sealing process. In this case, a glass solder ring 16, e.g. G61 from NGK, bears on the end wall 12, here realized as associated with a stopper 19, of the discharge vessel 11. The electrical Nb leadthrough 10, carrying an electrode 15 welded thereto, is inserted into a central hole 17 of the stopper. Said leadthrough has a stop 20 embodied as a step.

This structural unit is introduced into a furnace. After evacuation, argon is filled into the furnace with a pressure of between 100 hPa and 1000 hPa. The furnace is heated to an extent such that the glass solder melts, e.g. at 1350-1400° C. The liquid glass solder that arises flows into the capillary 17 present between the leadthrough and the hole into the stopper. At the same time, the leadthrough 10 sinks on account of its own weight this may be (0.5 to 1 g, for example) until the stop 20 bears on the upper edge 12 of the stopper. The heating is then switched off and the liquid glass solder undergoes transition to a solid vitreous state.

Figure 6:
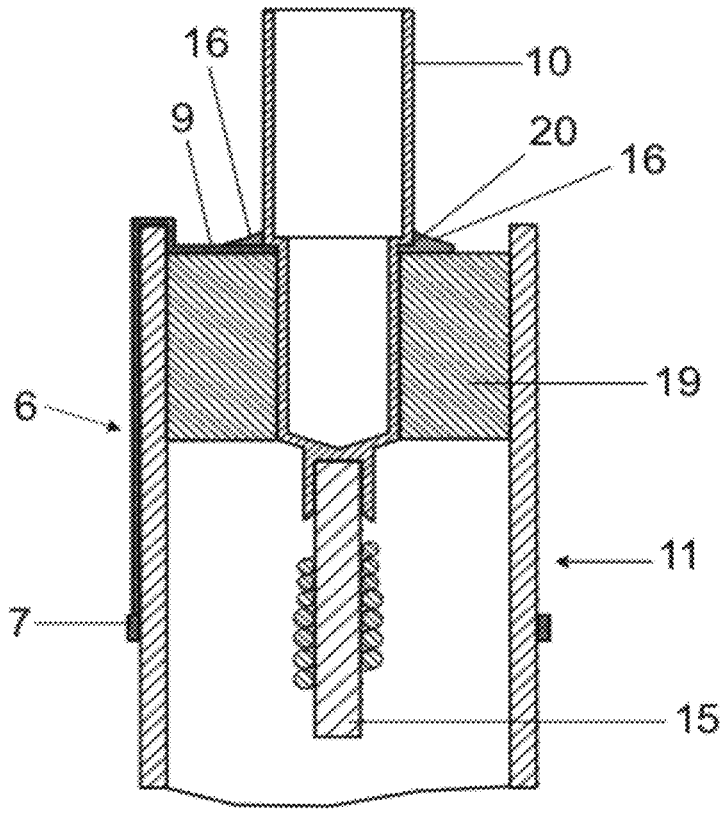
FIG. 6 shows the cross section through the upper region of the discharge vessel after the fuse-sealing, in which the capillary is filled with the glass solder and the leadthrough bears on the stopper and the hybrid antenna.

A cross section of such a completed fuse-sealing is shown schematically in FIG. 6. The stop 20 touches the end piece 9 of the hybrid antenna; in particular, it bears on the end piece.

The furnace is then opened. After the introduction of the filling, e.g. amalgam, the second fuse-sealing is effected, such that the starting gas, e.g. xenon with a suitable pressure, is filled into the furnace chamber. After the second fuse-sealing has been completed, the discharge vessel is tested. Afterward, the discharge vessel is incorporated into a lamp, e.g. a lamp having a tubular outer bulb.

During the fuse-sealing process, the liquefied glass solder is taken up on account of its surface tension in the capillary between the leadthrough and the outer wall of the stopper and in this case, in particular, also readily between the leadthrough and the surface of the hybrid antenna. After cooling, the glass solder remains at this location, such that layer thicknesses of 10 μm to 100 μm can still be detected at the thinnest location. This layer composed of insulating glass solder has a large ohmic resistance; the latter is normally greater than 10 kΩ. Since the capacitive coupling on account of the small surfaces is also significantly less than e.g. 55 pF, such a hybrid antenna would be ineffectual. The starting voltage of the lamp is then not reduced.

Proceeding from this, various techniques and measures were developed in order preferably to realize a secure connection with a very low ohmic resistance, e.g. less than 100Ω, which is designated as a good connection hereinafter.

One basic embodiment for producing an electrically highly conductive connection between the leadthrough and the hybrid antenna consists first of all in forming a smooth step at the leadthrough with good contact.

Figure 7:
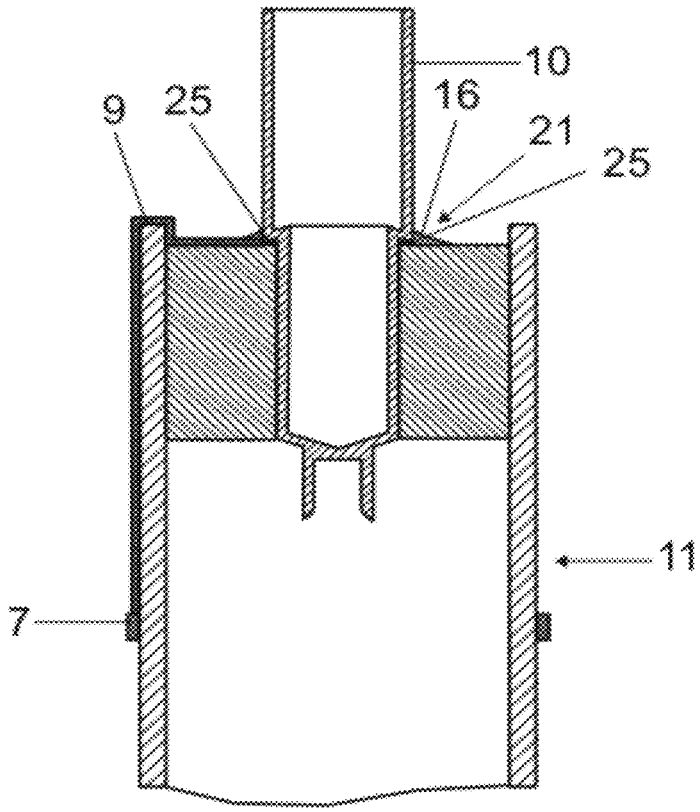
FIG. 7 shows the cross section through the upper region of the discharge vessel after the fuse-sealing, in which the leadthrough has a cutting edge that displaces the glass solder, and a reliable connection to the hybrid antenna is thus realized.

One preferred embodiment includes forming a step with cutting edge 21 instead of the smooth step in the case of the leadthrough 10 (see FIG. 7). This can be achieved by changing the dies for the extrusion method. Given an external diameter of the leadthrough 10 of, for example, 3.7 mm and a diameter of 3.0 mm in the region of the fuse-sealing, the cutting edge 21 can have a height of 0.2 mm to 1 mm, preferably 0.5 mm. During the fuse-sealing process, the cutting edge 21 comes down onto the hybrid antenna 6, more precisely onto the extension line 9, and the majority of the liquid glass solder 16 is displaced by the cutting edge 21. Therefore, the amount of glass solder remaining between the cutting edge and the hybrid antenna is significantly reduced, which already leads to an electrical connection having a sufficiently low ohmic resistance of typically 50Ω.

Figure 8:
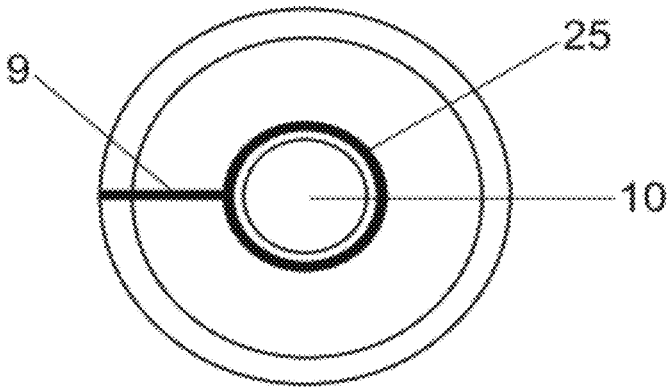
FIG. 8 shows the plan view of the side of a PCA ceramic, in which the hybrid antenna, as a result of the shaping of a ring, ensures a reliable contact even in the case of unevenness of the cutting edge of the leadthrough.

In general, the cutting edge 21 formed at the leadthrough 10, e.g. composed of niobium, has no planarity that is smaller than the height or thickness of the hybrid antenna, e.g. 25 μm. In order to obtain a reliable contact with the hybrid antenna 6, therefore, the contact area on the hybrid antenna is increased by the formation of a ring 25 as end piece on the stopper of the PCA ceramic (FIG. 8). In this case, the average diameter of said ring 25 is intended to correspond approximately to the diameter on which the cutting edge 21 runs, e.g. 3.7 mm. A contact between both is at least intended to be possible. The internal diameter of the ring 25 results from the tolerance within the hole of the stopper and the cutting edge 21, e.g. as 3.5 mm, and the external diameter results analogously, e.g. as 3.9 mm.

Figure 9:
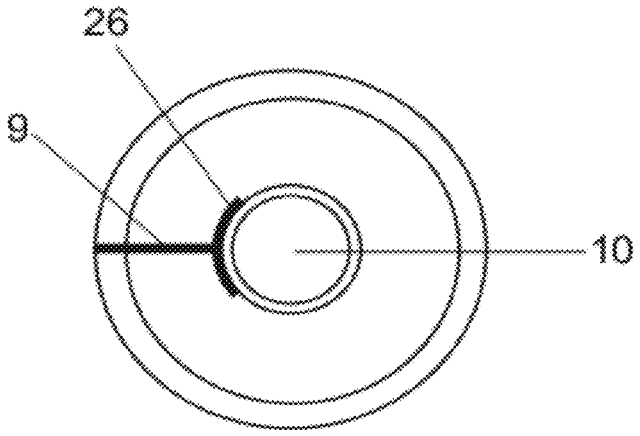
FIG. 9 shows the plan view of the side of a PCA ceramic, in which the hybrid antenna is formed as a ring segment instead of a ring, in order to minimize the surface area of the hybrid antenna in the region of the fuse-sealing.

The surface and also the composition of the hybrid antenna 6 as cermet, e.g. including 90% by weight tungsten and 10% by weight aluminum oxide, differ significantly from the surface and the structure of the discharge vessel 11 itself. Therefore, the intermediate layer arising between the glass solder 16 and the hybrid antenna 6 is also a different intermediate layer than between the discharge vessel and the glass solder with the consequence that the thermal behavior and the impermeability of this system are likewise different. In order to minimize the influence of such disturbances, the area of the extension line 9 in the region of the fuse-sealing region should likewise be as small as possible. That can be achieved in the present design by virtue of the fact that instead of the full circle, namely ring 25, only a partial circle 26, in particular a partial circle segment (FIG. 9), with an angle $+/-\phi_A$, e.g. +/−45°, with respect to the axis of the feeding extension line 9 is applied. A sufficient electrical connection between the hybrid antenna 6 and the metallic leadthrough 10 can already be achieved with this construction.

Figure 10:
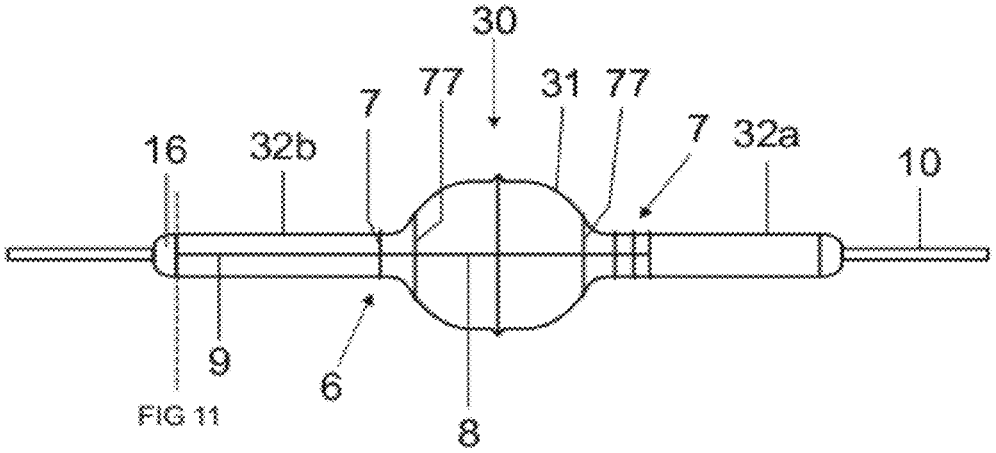
FIG. 10 shows the plan view of the discharge vessel of a metal halide high-pressure discharge lamp with a spherical discharge vessel and cylindrical capillaries, in which the hybrid antenna has a plurality of rings running around the capillaries and two rings running at the level of the discharge vessel around the latter, and a line which connects all the rings and which proceeds further as far as the electrode on the left-hand side.
Figure 11:
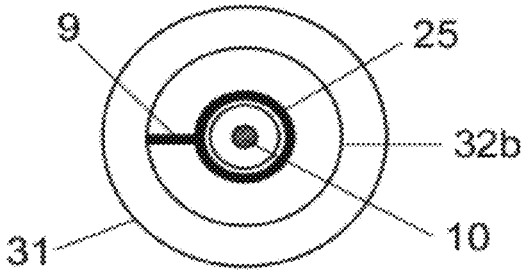
FIG. 11 shows the plan view of the capillary of the PCA ceramic with the hybrid antenna, which is formed into a circle via a web.

In a further exemplary embodiment, the new connection technique is applied in the case of a metal halide high-pressure discharge lamp 30 including a discharge vessel 31 composed of ceramic. FIG. 10 shows a discharge vessel 31, having a PCA ceramic, with a spherical discharge space and cylindrical fuse-sealing regions, the so-called capillaries 32*a* and 32*b*, into which two electrode systems, not illustrated, with leadthroughs 10 are fuse-sealed. The hybrid antenna 6 is constructed here as follows: in order to generate a plasma in the capillary region, a plurality of rings 7 surrounding the capillary are arranged around the first capillary 32*a*. Only one ring 7 is arranged on the outside around the second capillary 32*b*. In the region of the bulbous discharge vessel, furthermore, two rings 77 assigned to the discharge vessel are arranged at the level of the electrodes. All the cermet rings 7, 77 are connected to one another by a connection line 8 composed of cermet. The latter runs as far as the outer end of the second capillary 32*b* and extends further over the end side of the capillary, where it ends in a ring 25 as end piece, which is shown in FIG. 11, the plan view of the PCA front side. The ring makes contact with the leadthrough 10.

Figure 12:
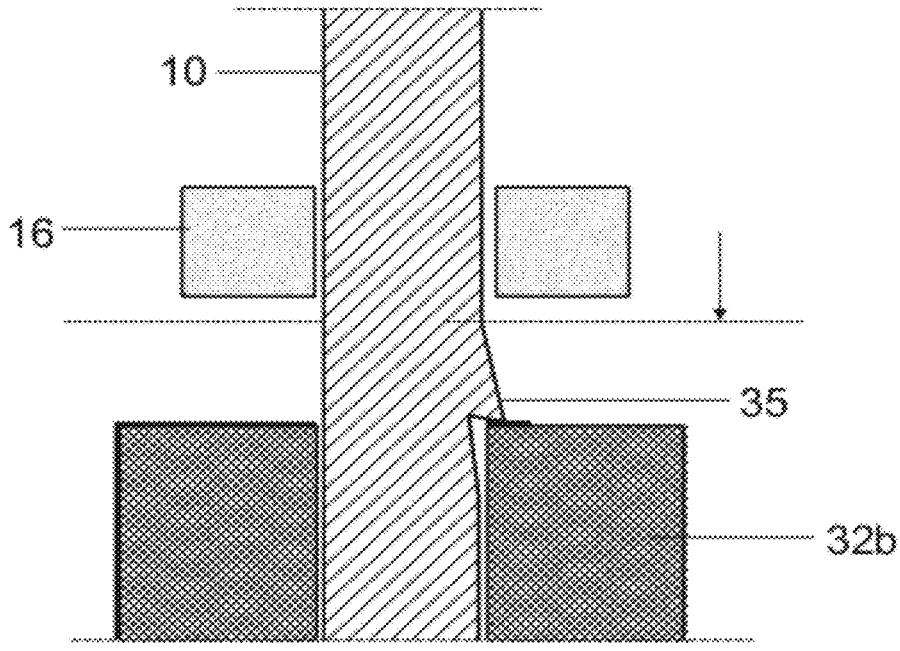
FIG. 12 shows the cross section of the discharge vessel before the fuse-sealing with the capillary of the PCA ceramic, the hybrid antenna, the glass solder ring, which here normally bears on the surface of the PCA ceramic, the leadthrough with the scraped-in lug bearing on the hybrid antenna.

In one preferred exemplary embodiment, the depth to which the leadthrough 10 together with the electrode sinks into the capillary 32*a* or 32*b* is defined by a plurality of outwardly projecting lugs 35, e.g. three thereof, which can be scraped, for example, into the leadthrough by means of a knife (FIG. 12). Said lugs 35 are arranged around the circumference of the leadthrough 10 regularly, e.g. at an angle of 120°. Since the orientation of the lugs is not defined during the production process, for reliably making contact with the hybrid antenna 6 it is necessary for the end piece to be embodied as ring 25 as illustrated or at least as a partial circle segment 26 in a manner similar to that in FIG. 9 with a sufficiently large angle $+/-\phi_A$, e.g. +/−65°.

Figure 13:
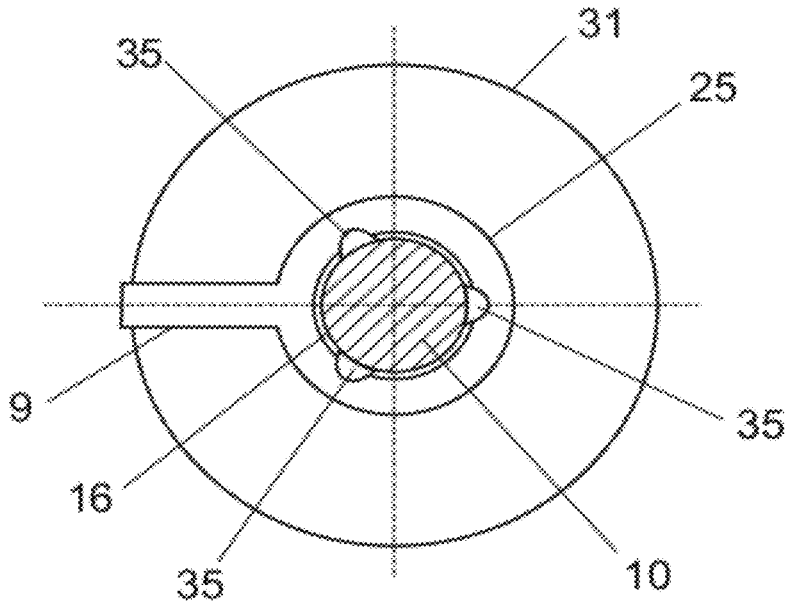
FIG. 13 shows the plan view of the PCA ceramic with the leadthrough, from position A in FIG. 12, in which it can be seen how the three lugs bear on the surface of the hybrid antenna.

During the fuse-sealing process, the leadthrough 10 with the electrode is introduced into the capillary 32 of the discharge vessel, to be precise in such a way that the lugs 35, or at least one of the lugs 35, come(s) down onto the ring 25, or else partial circle segment 26 (FIG. 13). The glass solder ring 16 is subsequently placed thereon and heated.

Figure 14:
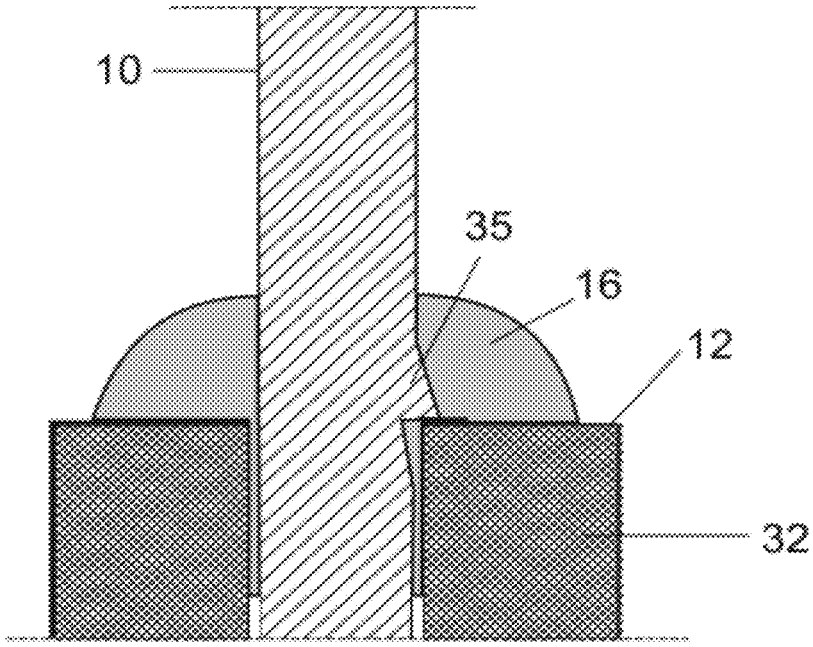
FIG. 14 shows the cross section through the discharge vessel in the region of the fuse-sealing after the fuse-sealing process.

This unit is fuse-sealed (FIG. 14). In this example, the diameters of the leadthrough 10, e.g. 0.73 mm, and the internal diameter of the capillary 32, e.g. 0.8 mm, are very small. As a general rule, for simple mechanical contact-making it suffices if the lugs 35 have a height, relative to the undisturbed surface of the leadthrough, of e.g. 0.05 mm to 0.08 mm, which corresponds to an overhang onto the end face 12 of 0.015 mm to 0.045 mm.

For applying the sintering line of the hybrid antenna, a type of ink is used. Since this ink, for the production of the hybrid antenna, is not intended to pass into the interior of the capillary, a minimum distance of, for example, 0.020 mm between the end piece of the hybrid antenna, said end piece being bent in a ring-shape fashion at least in segments, and the hole in the capillary 32 is necessary for technical reasons. Since the hybrid antenna cannot form a wholly exact ring for technical reasons, it is advantageous additionally to include a tolerance of, for example, 0.020 mm. In order that the lugs 35 can form a reliable electrical contact-connection to the sintered ring 25, the overhang of the lugs 35 should advantageously be increased by the minimum distance of the hybrid antenna from the capillary, thereby resulting in an excess of 0.090 mm to 0.120 mm for the exemplary embodiment mentioned. With the typical width of the line-like hybrid antenna of 0.30 mm +/−0.05 mm, it is possible for the lug to reliably make contact with the end piece. In FIG. 13, the plan view of the capillary with inserted leadthrough and the three lugs should be understood as not to scale.

The mechanical construction of the leadthrough and the hybrid antenna, in particular the ring-segment-like end thereof, are the prerequisite for a good electrical connection between the hybrid antenna and the leadthrough. Nevertheless, during the fuse-sealing process, on account of the high surface tensions of the glass solder, the leadthrough can rise somewhat, as a result of which an insulating glass solder layer can form between the leadthrough and the end piece of the hybrid antenna. In order to prevent this, it is recommended that the electrode system normally inserted freely into the capillary, that is to say leadthrough incl. the electrode, which system has a mass of typically 0.8 g, be weighted by a weight such that the leadthrough is fixedly pressed onto the end piece of the hybrid antenna.

Alternatively, the leadthrough should be held in a manner pressed sufficiently fixedly thereon. For this purpose, it is possible to use a weight having a mass in the range of 0.5 g to 20 g, preferably 3 g to 7 g. It is likewise possible to press the PCA ceramic and the leadthrough against a stop by means of a spring. Other technical measures for ensuring the good contact-making are also suitable.

Figure 15:
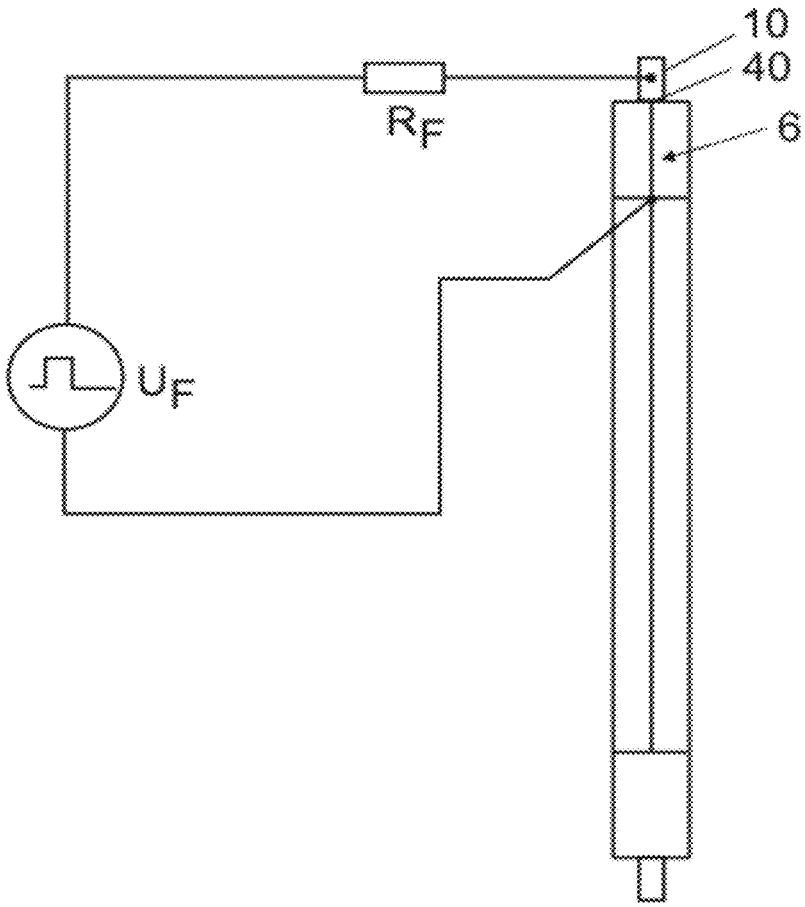
FIG. 15 shows a basic circuit diagram for the forming device, with the pulsed voltage source $U_F$ and the series resistor $R_F$, which are connected to the leadthrough and the hybrid antenna.

A further method for producing a good electrical connection between leadthrough 10 and hybrid antenna 6 with a defined resistance, e.g. less than 100Ω, consists in carrying out a resistance welding between them. For this purpose, a pulsed voltage source $U_F$ with a series resistor $R_F$ is connected to the hybrid antenna 6 and the leadthrough 10 for forming purposes (FIG. 15). The breakdown field strength of the glass solder used is between 200 kV/cm and 500 kV/cm. With expected glass solder layer thicknesses of between 10 μm and 200 μm, the required breakdown voltage thus lies between 0.3 kV and 6 kV. In order to prevent a breakdown through the air along the surface of the glass solder, a peak voltage of 2 kV is chosen here, whereby for instance glass solder layer thicknesses of 50 μm can then be brought to breakdown.

During the breakdown, an electrically conductive channel arises, through which an electric current flows. Upon addition of a sufficient electrical energy, the glass solder is heated within the channel, e.g. having a diameter of 30 μm and a length of 50 μm, to temperatures of e.g. 4000° C., as a result of which the surface of the leadthrough 10 present, e.g. niobium having a melting point of 2468° C. and the surface of the hybrid antenna present, e.g. including tungsten as constituent having a melting point of 3410° C., are also liquefied. The molten metals, here W and Nb, thereupon mix with the glass solder in the region of the channel. After the current flow has ended, said channel cools down very rapidly, as a result of which a solid mass arises again, which, however, has become conductive on account of the metallic additives. The conductive glass solder produced in the channel as a result of the forming is constituted such that its resistance is sufficiently low, e.g. less than 1000Ω, but preferably less than 100Ω. In this case, the conductive glass solder in the channel 40, on account of the altered properties by comparison with the insulating glass solder, is not permitted to cause any thermal stresses which, over the lifetime of the lamp, would lead to cracks in the insulating or conductive glass solder or therebetween. Therefore, the enrichment of the glass solder with the metals in the region of the channel 40 should be as small as possible, which can be achieved by means of a relatively large width of the channel. Both variables can be defined by the energy that is coupled in during the breakdown, and by the action time of the energy. Therefore, the energy should be in the range of 0.1 mJ to 500 J, preferably 0.5 to 2 mJ. The action time should be between 100 ns and 500 s, and preferably 0.5 to 5 s.

Figure 16:
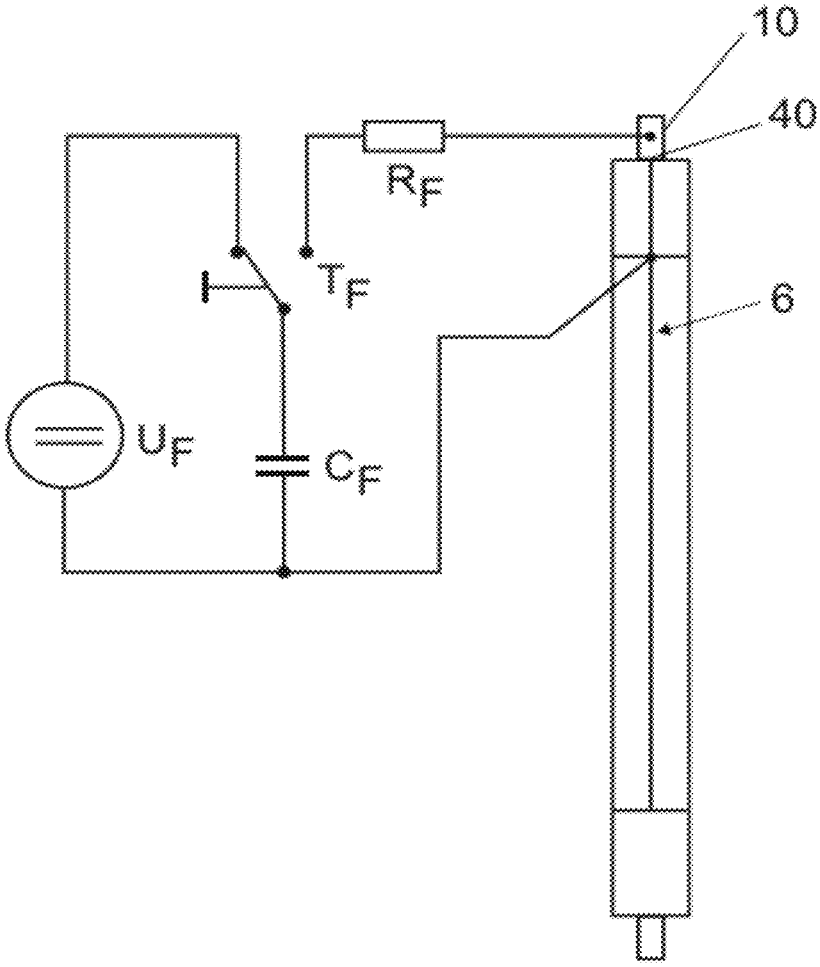
FIG. 16 shows a simplified circuit for the formatting in which a capacitor $C_F$ charged by means of the voltage source $U_F$ is discharged via the resistor $R_F$ after changeover by means of the switch $T_F$.

FIG. 16 shows a simple circuit that can be used to realize said resistance welding. In this case, firstly the capacitor $C_F$ is charged with the DC voltage $U_F$. Afterward, the switch TF is changed over, as a result of which a voltage that leads to breakdown is present between the hybrid antenna 6 and the leadthrough 10, such that the series resistor $R_F$ limits the current and the discharge time of the capacitor and hence the action time and hence the width of the channel are defined by means of the constant $R_F \cdot C_F$. The capacitance of the capacitor in turn is proportional to the energy introduced into the breakdown. Since, in practice, contact resistances are present at the changeover switch $T_F$ and at the contacts with the hybrid antenna and the leadthrough, the specific values for the capacitor and the series resistor have to be determined empirically. The capacitance is in the range of 0.5 nF to 50 nF and the resistance is between 10Ω and 1 kΩ.

In another exemplary embodiment, a superimposed-pulse starting unit or a reference starting unit can be used for the forming or resistance welding. Said unit should be able to generate voltage pulses having amplitudes of up to 2 kV and pulse durations of 0.5 μs to 10 μs. Given a repetition rate of 50 Hz and given a coupling-in of energy of 1 mJ per pulse, a conductive connection between the starting line and the leadthrough can be achieved after welding times of up to ten minutes. In order to shorten the welding time down to the seconds range, it is possible to increase the repetition rate of the pulses, e.g. to up to 50 kHz, and/or to raise the energy to up to 10 mJ per pulse.

At the end of discharge vessel production, discharge vessel testing takes place, inter alia a starting test being made. In the case of the high-pressure discharge lamp including the hybrid antenna, in addition to the other tests, the ohmic resistance is measured by means of a resistance measuring instrument. Should said resistance be above a limit value, e.g. 100Ω, a forming process is carried out for this discharge vessel. Afterward, the resistance is measured again. If the resistance lies above the limit value in this case, too, the discharge vessel is rejected. The investigations show that in the case of the known materials for the starting line consisting of 25% to 75% tungsten and 75% to 25% aluminum oxide given a width of the starting line of 0.3 mm and a thickness of 3 μm, the ohmic resistance is less than 1 Ω/cm, as a result of which, in the measurement between the end of the starting line and the leadthrough, the contact resistances in the case of direct contact-making are less than 0.5Ω. A connection can be regarded as in order if the resistance is less than 1Ω. This small resistance can likewise be realized by means of a welding process.

In accordance with some embodiments, a high-pressure discharge lamp with starting aid includes a discharge vessel composed of ceramic, two electrodes to which leadthroughs toward the outside are attached, and a starting aid embodied as a hybrid antenna having at least two rings around the discharge vessel and a connection line connecting them. The leadthroughs are fuse-sealed into the end of the discharge vessel by means of glass solder. On one side an extension part of the starting aid is formed as far as a leadthrough. A means between leadthrough and extension part limits the ohmic resistance between leadthrough and extension part to at most 10 kΩ, and preferably to at most 100Ω.

One or more of the following features may be included or combined in the above implementations. The high-pressure discharge lamp may be configured such that the extension part ends in an end piece, preferably embodied as a ring, annulus or segment, also called partial circle, thereof, which is spaced apart from the leadthrough and preferably at least partly surrounds the leadthrough. The distance may be at most twice the magnitude of, preferably at most the same magnitude as, the diameter of the leadthrough. The high-pressure discharge lamp may be configured such that the leadthrough is a tube or pin, such that an outwardly projecting local projection is fitted thereto as the means, such that the projection has, in the direction toward the electrode, in particular, a cutting edge which makes contact with the extension part at the end piece thereof. The high-pressure discharge lamp is may be configured such that a mechanical pressure is exerted between the discharge vessel and the leadthrough during the fuse-sealing process. The high-pressure discharge lamp may be configured such that the means is a conductive channel in the region of the glass solder which contains metal alongside glass solder and which extends in a line-like manner between end piece and leadthrough, such that a forming process has been applied, in particular, in which the electrically insulating or high-impedance connection between the leadthrough and the extension part in the channel is made to have low impedance. The high-pressure discharge lamp may be configured such that the leadthrough is a tube or pin, such that an outwardly projecting projection is fitted thereto as the means, which projection makes contact with the extension part. The high-pressure discharge lamp may be configured such that the projection is embodied as a step. The high-pressure discharge lamp may be configured such that the projection is embodied as a step with a cutting edge in the direction of the electrode. The high-pressure discharge lamp may be configured such that the leadthrough is a tube or pin, such that an outwardly projecting local projection is fitted thereto as the means, such that the projection has, in the direction toward the electrode, one or a plurality of contact points making contact with the extension part at the end piece thereof. The high-pressure discharge lamp may be configured such that the contact points are ends of a scraped portion. The high-pressure discharge lamp as claimed in claim 1, characterized in that the leadthrough is a tube or pin, such that an outwardly projecting projection is fitted thereto as the means, which projection makes contact with the extension part. The high-pressure discharge lamp may be configured such that the projection is embodied as a step, in particular with a cutting edge in the direction of the electrode. The high-pressure discharge lamp may be configured such that the ohmic resistance is 0.2 to 1Ω. A particularly reliable connection may be obtained if a resistance of 0.3Ω to 0.5Ω is present between cermet starting line and niobium leadthrough. Overall, the resistance should preferably be less than 1Ω.

In accordance with further embodiments, a method for producing the high-pressure discharge lamp may be such that a forming process is applied, such that, for the purpose of forming, a pulsed voltage is connected between the hybrid antenna, on the one hand, and the leadthrough, on the other hand. The method may be such that the voltage present is a maximum of 6 kV, preferably at least 1 kV, in that the pulse duration is between 100 ns and 100 μs, preferably 0.5 to 5 μs, and in that the energy introduced into the channel is 0.1 mJ to 10 mJ, preferably 0.5 to 2 mJ.

What is claimed is:

1. A high-pressure discharge lamp, comprising:

a discharge vessel composed of ceramic;

at least one leadthrough for an electrode, fuse-sealed into an end of the discharge vessel by means of glass solder; and a starting aid comprising:

at least two rings around the discharge vessel;

a connection line connecting the two rings; and an extension part extending from one of the rings to a region proximal to the leadthrough;

wherein a contact protrusion between the leadthrough and the extension part limits the ohmic resistance to at most 10 kΩ.

2. The high-pressure discharge lamp as claimed in claim 1, wherein the contact protrusion limits the ohmic resistance between leadthrough and extension part to at most 100Ω.

3. The high-pressure discharge lamp as claimed in claim 1, wherein the extension part ends in an end piece which is spaced apart from the leadthrough and at least partly surrounds the leadthrough.

4. The high-pressure discharge lamp as claimed in claim 3, wherein the spaced apart distance between the end piece and the leadthrough is at most twice the magnitude of the diameter of the leadthrough.

5. The high-pressure discharge lamp as claimed in claim 4, wherein the spaced apart distance between the end piece and the leadthrough is at most the same magnitude as the diameter of the leadthrough.

6. A method for producing a high-pressure discharge lamp as claimed in claim 5, wherein a forming process is applied, and wherein, for the purpose of forming, a pulsed voltage is connected between the hybrid antenna, on the one hand, and the leadthrough, on the other hand.

7. The method as claimed in claim 6, wherein the voltage present is a maximum of 6 kV, in that the pulse duration is between 100 ns and 100 μs, and in that the energy introduced into the channel is 0.1 mJ to 10 mJ.

8. The high-pressure discharge lamp as claimed in claim 3, wherein the leadthrough is a tube or pin, wherein an outwardly projecting local projection is fitted thereto as the contact protrusion, and wherein the projection has a cutting edge which makes contact with the extension part at the end piece thereof.

9. The high-pressure discharge lamp as claimed in claim 8, wherein the cutting edge is in the direction toward the electrode.

10. The high-pressure discharge lamp as claimed in claim 3, wherein the means is a conductive channel in the region of the glass solder which contains metal alongside glass solder and which extends in a line-like manner between end piece and leadthrough, and wherein a forming process has been applied, in in which the electrically insulating or high-impedance connection between the leadthrough and the extension part in the channel is made to have low impedance.

11. The high-pressure discharge lamp as claimed in claim 1, wherein a mechanical pressure is exerted between the discharge vessel and the leadthrough during the fuse-sealing process.

12. The high-pressure discharge lamp as claimed in claim 1, wherein the leadthrough is a tube or pin, and wherein an outwardly projecting projection is fitted thereto as the contact protrusion, which projection makes contact with the extension part.

13. The high-pressure discharge lamp as claimed in claim 12, wherein the projection is embodied as a step.

14. The high-pressure discharge lamp as claimed in claim 12, wherein the projection is embodied as a step with a cutting edge in the direction of the electrode.

15. The high-pressure discharge lamp as claimed in claim 12, wherein the leadthrough is a tube or pin, wherein an outwardly projecting local projection is fitted thereto as the contact protrusion, and wherein the projection has, in the direction toward the electrode, one or a plurality of contact points making contact with the extension part at the end piece thereof.

16. The high-pressure discharge lamp as claimed in claim 15, wherein the contact points are ends of a scraped portion.

17. The high-pressure discharge lamp as claimed in claim 1, wherein the ohmic resistance is 0.2 to 1Ω.

18. The high-pressure discharge lamp as claimed in claim 17, wherein the projection is embodied as a step with a cutting edge in the direction of the electrode.

* * * * *